US007281383B2

(12) United States Patent
Redlich

(10) Patent No.: US 7,281,383 B2
(45) Date of Patent: Oct. 16, 2007

(54) RECIPROCATING FOUR-STROKE BRAYTON REFRIGERATOR OR HEAT ENGINE

(76) Inventor: Robert Walter Redlich, 9 Grand Park Blvd., Athens, OH (US) 45701

( * ) Notice: Subject to any disclaimer, the term of this patent is extended or adjusted under 35 U.S.C. 154(b) by 449 days.

(21) Appl. No.: 11/089,664

(22) Filed: Mar. 25, 2005

(65) Prior Publication Data

US 2006/0213207 A1 Sep. 28, 2006

(51) Int. Cl.

| | |
|---|---|
| ***F25B 9/00*** | (2006.01) |
| ***F25B 23/00*** | (2006.01) |
| ***F01B 29/10*** | (2006.01) |
| ***F02G 1/04*** | (2006.01) |

(52) U.S. Cl. ..... 62/6; 60/517; 62/467

(58) Field of Classification Search ..... 62/6, 62/467; 123/204; 60/517, 520

See application file for complete search history.

(56) References Cited

U.S. PATENT DOCUMENTS

| | | | | |
|---|---|---|---|---|
| 2,981,082 | A * | 4/1961 | Sixsmith | 62/401 |
| 3,312,072 | A * | 4/1967 | Gifford | 62/6 |
| 3,844,117 | A * | 10/1974 | Ryan | 123/212 |
| 4,498,295 | A * | 2/1985 | Knoos | 60/517 |
| 4,815,290 | A * | 3/1989 | Dunstan | 60/517 |
| 5,095,700 | A * | 3/1992 | Bolger | 60/517 |
| 6,739,139 | B1 * | 5/2004 | Solomon | 62/6 |
| 6,886,326 | B2 * | 5/2005 | Holtzapple et al. | 60/39.6 |
| 6,968,703 | B2 * | 11/2005 | Warren | 62/6 |
| 7,003,964 | B2 * | 2/2006 | Solomon | 62/6 |
| 2006/0064976 | A1 * | 3/2006 | Sakita | 60/519 |
| 2006/0280993 | A1 * | 12/2006 | Keefer et al. | 429/34 |
| 2007/0028611 | A1 * | 2/2007 | Johnston et al. | 60/520 |

* cited by examiner

*Primary Examiner*—William C Doerrler
(74) *Attorney, Agent, or Firm*—Frank H. Foster

(57) ABSTRACT

A thermal machine that can function as either a refrigerator or an external combustion heat engine is disclosed. A working gas undergoes four thermodynamic processes that comprise a Brayton cycle. Two of these processes, adiabatic compression and adiabatic expansion, take place in the same cylinder, within which a piston, driven by a crankshaft, reciprocates. The remaining two processes, each of which is a transfer of heat at constant pressure, take place in a high pressure heat exchanger and a low pressure heat exchanger. A rotary valve, rotating at one-half crankshaft speed, creates passages between the cylinder and the heat exchangers, and is constructed so that compression and expansion ratios are equal.

8 Claims, 7 Drawing Sheets

Refrigeration Cycle

Heat Engine Cycle

RECIPROCATING FOUR-STROKE BRAYTON REFRIGERATOR OR HEAT ENGINE

BACKGROUND OF THE INVENTION

1. Field of the Invention

The invention is in the field of closed cycle thermal machines that use gas as a working substance and are applicable as either a refrigerator or an external combustion heat engine.

2. Description of the Related Art

One purpose of the invention is to provide an efficient refrigerator that uses an environmentally harmless, non-inflammable and non-toxic refrigerant, in order to overcome drawbacks of vapor compression refrigerators that are in common use. Vapor compression refrigerants are generally HFCs or hydrocarbons such as isobutane, both of which are objectionable; HFCs because of environmental effects and hydrocarbons because they are inflammable. Considered as a thermodynamic cycle, vapor compression refrigeration has two intrinsic sources of inefficiency, neither of which exist in the invention. One is that compressed vapor reaches a temperature much higher than ambient temperature, and then is cooled to near ambient temperature in a thermodynamically irreversible process that lowers efficiency. Secondly, expansion of warm liquid to cold vapor in a capillary or expansion valve sacrifices potentially recoverable expansion work.

Another purpose of the invention is to provide an efficient external combustion engine using the same configuration as is capable of refrigeration according to the earlier stated purpose of the invention.

BRIEF SUMMARY OF THE INVENTION

The basic elements of the invention are: a) a sealed enclosure, b) within the enclosure, a crankshaft connected to a piston reciprocating in a cylinder, c) a high pressure heat exchanger outside the enclosure, d) a low pressure heat exchanger outside the enclosure, e) within the enclosure, a rotary valve, rotating at one-half crankshaft speed, that creates passages between the heat exchangers and the cylinder, f) working gas such as helium or nitrogen at a typical average pressure of 3 megapascals (30 bar), g) in a preferred embodiment, a counterflow heat exchanger that functions as a regenerator.

In a first basic embodiment, the crankshaft emerges from the enclosure through a gas-tight shaft seal, and is driven by an external source of power if the invention is used as a refrigerator.

If the invention is used as a heat engine, the crankshaft supplies power to an external load.

In a second basic embodiment, an electric motor within the sealed enclosure drives the crankshaft if the invention is used as a refrigerator. If the invention is used as a heat engine, an electric generator inside the enclosure absorbs power from the crankshaft.

According to either basic embodiment of the invention, working gas cycles successively through the following four processes which constitute a closed Brayton cycle;

1) adiabatic compression in the cylinder, followed by expulsion of compressed gas from the cylinder into the high pressure heat exchanger, 2) constant pressure heat transfer in the high pressure heat exchanger, either out of the gas to the environment if the invention is used as a refrigerator, or into the gas from an external heat source if the invention is used as a heat engine, 3) transfer of a controlled amount of gas from the outlet of the high pressure heat exchanger into the cylinder, where it expands adiabatically with an expansion ratio equal to the compression ratio of process 1) above, and then is expelled into the low pressure heat exchanger, 4) constant pressure heat transfer in the low pressure heat exchanger, either into the working gas if the invention is used as a refrigerator, or out of the working gas to the environment if the invention is used as a heat engine. Gas exiting the low pressure heat exchanger is drawn into the cylinder to repeat process 1) and the remainder of the cycle.

In a preferred embodiment of the invention, a regenerator in the form of a counterflow heat exchanger is combined with either basic embodiment for the purpose of reducing pressure and temperature changes during expansion and compression. If the preferred embodiment is a heat engine, adding a regenerator increases the ratio [power output/piston displacement], for a specified maximum pressure. If the preferred embodiment as a refrigerator, adding a regenerator increases the ratio [heat removed from the refrigerated space/piston displacement], for a specified maximum pressure.

(G) BRIEF DESCRIPTION OF THE SEVERAL VIEWS OF THE DRAWINGS

Figure 1:
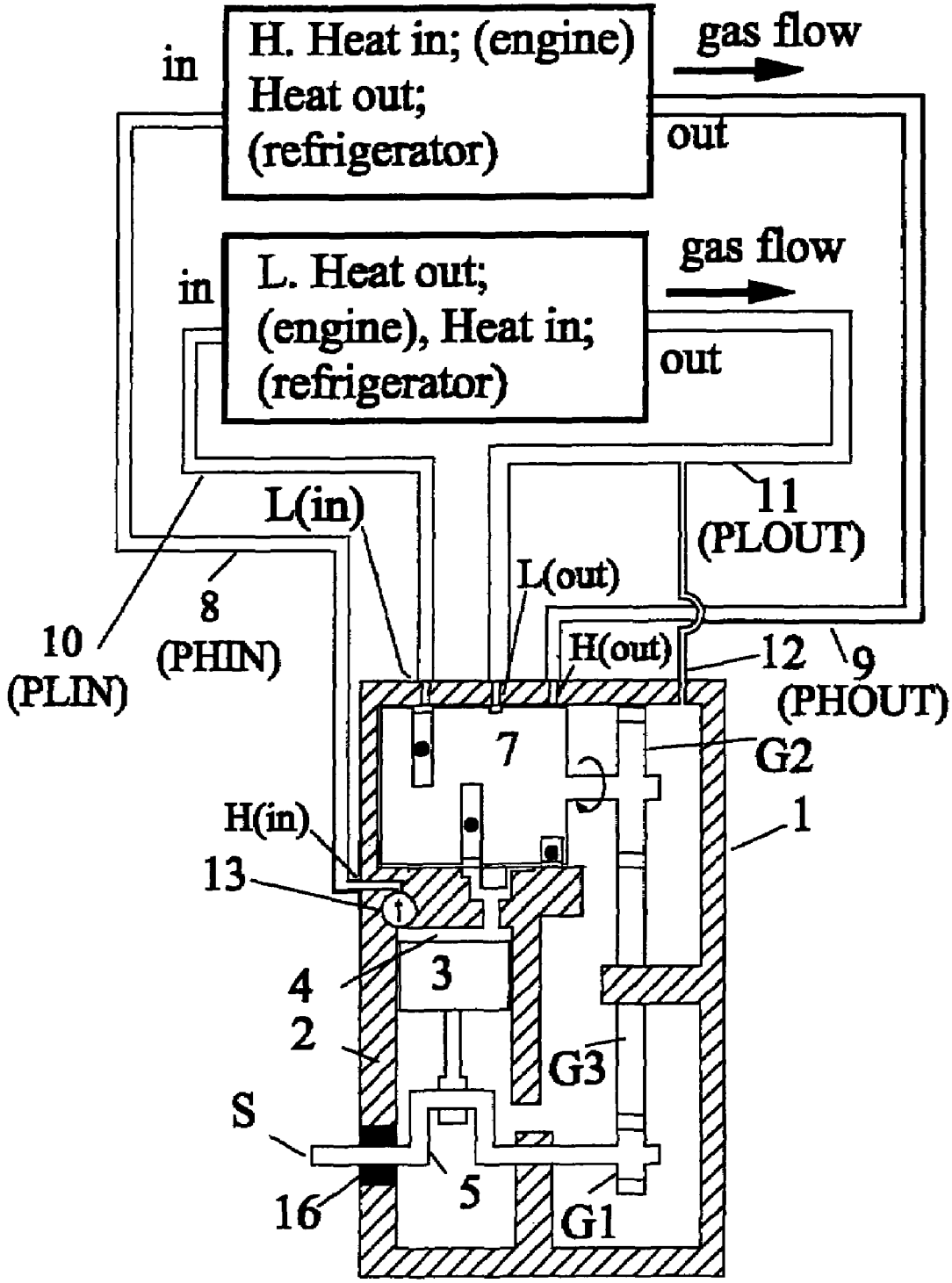
FIG. 1 shows a first basic embodiment of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

Figure 2:
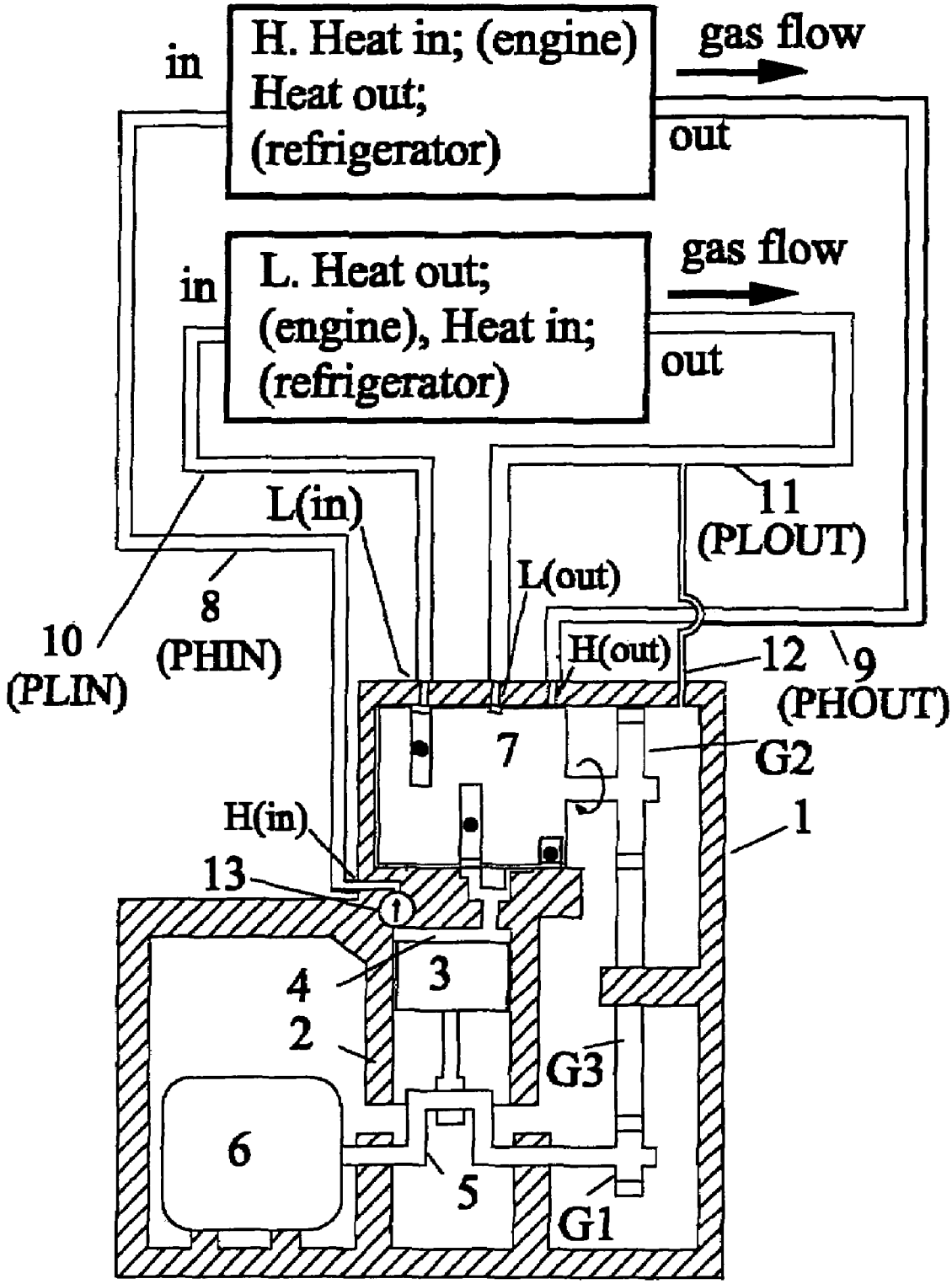
FIG. 2 shows a second basic embodiment of the invention.
Figure 3:
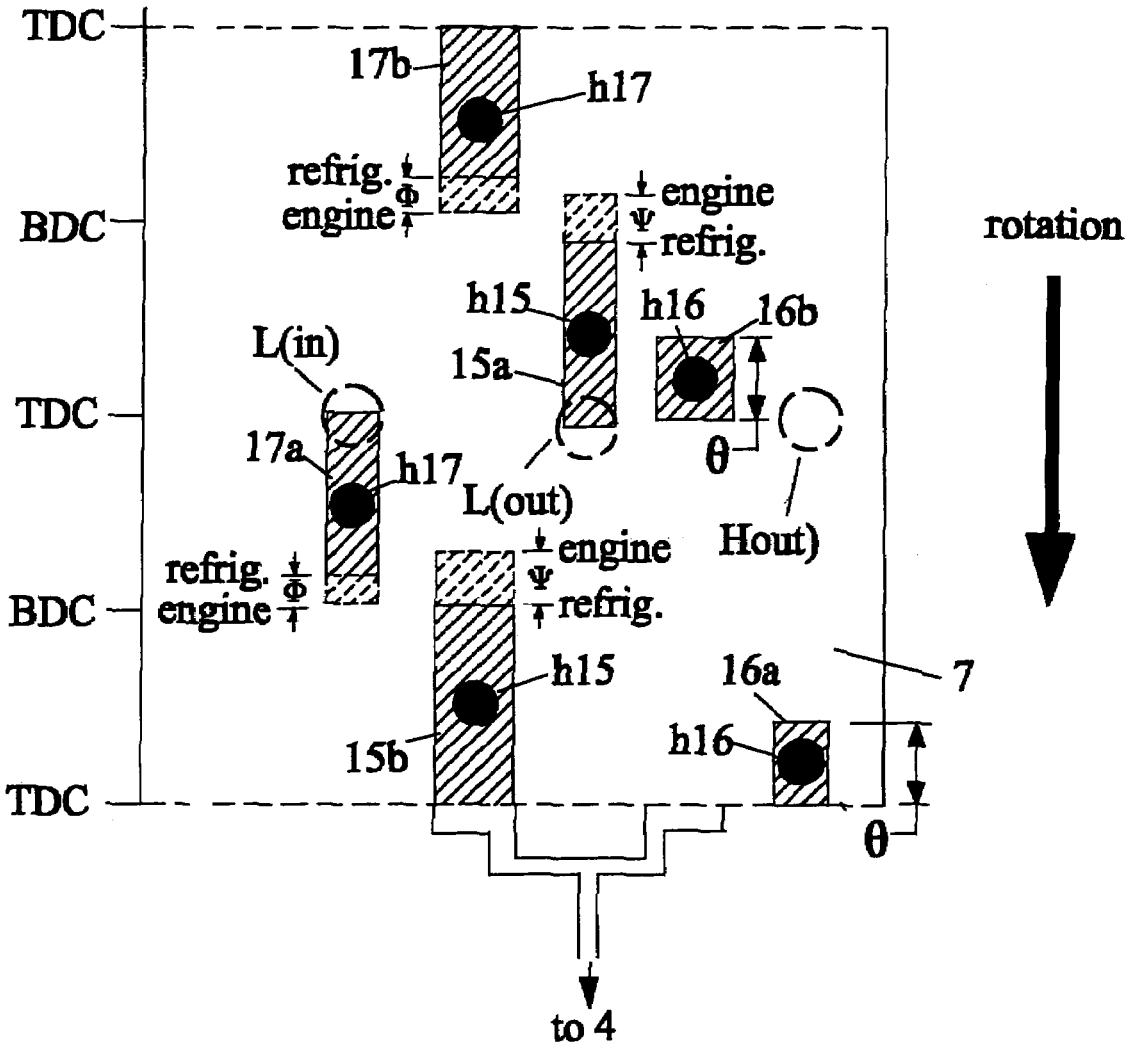
FIG. 3 shows the cylindrical surface of a preferred rotary valve, developed on to the plane of the drawing.

Referring to the first basic embodiment shown in FIG. 1, a sealed enclosure 1 contains a piston 3 in cylinder 2. Piston 2 and cylinder 3 define a work space 4. When the invention is used as a refrigerator, piston 3 is driven in reciprocation by crankshaft 5, and crankshaft 5 is rotated by torque applied at S by a source of power external to enclosure 1. Shaft seal 16 prevents leakage of working gas out of the interior of enclosure 1. When the invention is used as a heat engine, crankshaft 5 is driven by gas forces exerted on piston 2, and supplies power to a load connected to S external to enclosure 1. High pressure heat exchanger H is connected to enclosure 1 by sealed passages 8 (designated herein as PHIN) and 9 (designated herein as PHOUT) which enter enclosure 1 through ports H(in) and H(out). Low pressure heat exchanger L is connected to enclosure 1 by sealed passages 10 (designated herein as PLIN) and 11 (designated herein as PLOUT), which enter enclosure 1 through ports L(in) and L(out). The entire apparatus is filled with a working gas such as helium or nitrogen at a typical average pressure of 30 atmospheres. 12 is a capillary tube that equalizes pressures of heat exchanger L and the interior of enclosure 1. A cylindrical rotary valve 7 is rotated at one-half crankshaft speed by gears G1, G2, and G3. FIG. 3 shows the cylindrical surface of rotary valve 7. Shaded areas in FIG. 2 represent grooves in the cylindrical surface. Solid black circles in FIG. 3 represent holes running through 7 to connect grooved areas; for example hole h16 connects grooved areas 16*a* and 16*b*.

Figure 4:
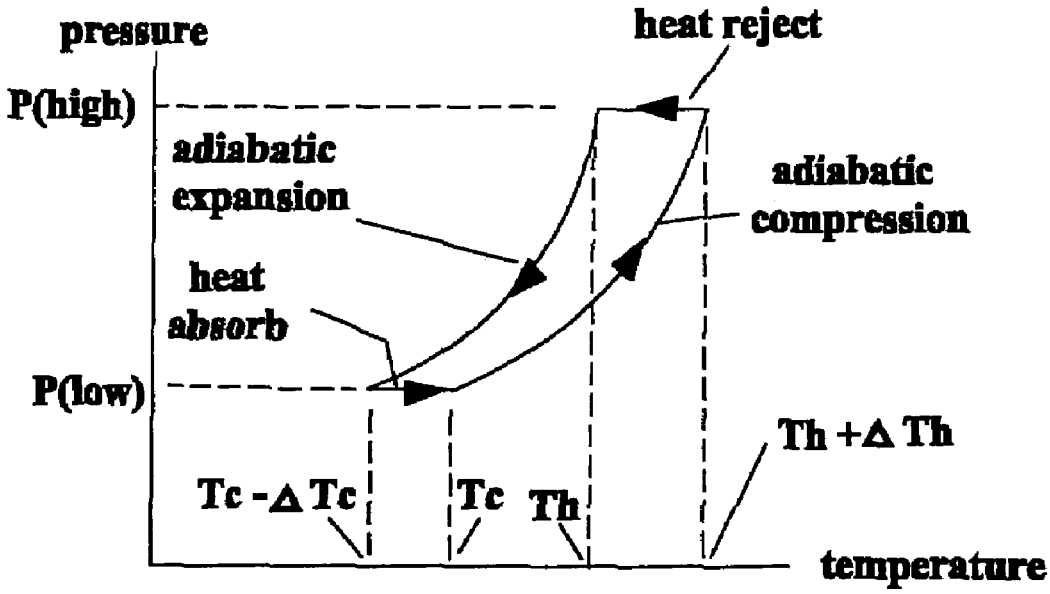
FIG. 4 shows a refrigeration thermodynamic cycle according to either basic embodiment of the invention, in a pressure-temperature plane.
Figure 5:
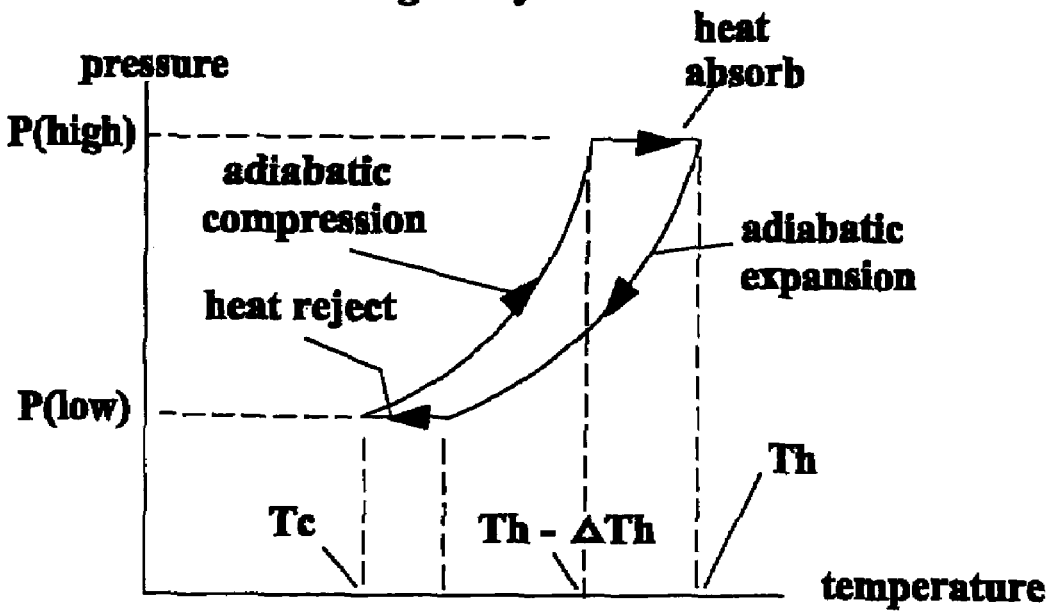
FIG. 5 shows a heat engine thermodynamic cycle according to either basic embodiment of the invention, in a pressure-temperature plane.

Passages created between working space 4 and heat exchangers H and L by rotary valve 7 cause the working gas of the basic embodiment to traverse a Brayton cycle as shown in FIGS. 4 and 5. In FIGS. 4 and 5;

Th=Temperature at the outlet of heat exchanger H, in degrees Kelvin

Tc=Temperature at the outlet of heat exchanger L, in degrees Kelvin

ΔTh=Temperature change in heat exchanger H, in degrees Kelvin

ΔTc=Temperature change in heat exchanger L, in degrees Kelvin

The design of rotary valve 7 is influenced by a condition implicit in FIGS. 3 and 4, namely, equality of the pressure ratio P(high)/P(low) for both compression and expansion. If expansion pressure ratio does not equal compression pressure ratio, pressure at the end of expansion will not equal P(low), resulting in lost expansion work and lower efficiency. It can be shown that, in order to meet the requirement of equal expansion and compression pressure ratios in both basic and preferred embodiments, it is necessary that;

$$VE/VC<1 \text{ (refrigerator)} \qquad \text{inequality 1}$$

$$VEVC>1 \text{ (refrigerator)} \qquad \text{inequality 2}$$

In inequalities 1 and 2,

VE=volume at end of expansion

VC=volume at beginning of compression

Steps in the cycle traversed by the working gas are affected by inequalities 1 and 2. These steps will now be described;

a) INTAKE. With piston 3 at top dead center (TDC) and with rotary valve 7 in the angular position shown in FIG. 2, a passage exists between L(out) and work space 4 via groove 15*a*, hole h15, and groove 15*b*. In a refrigerator embodiment, the existence of this passage persists for the interval of piston 2 motion from TDC to bottom dead center (BDC), during which interval gas is drawn into work space 4. In order to satisfy inequality 2 in an engine embodiment, the existence of this passage persists for an interval from TDC to an angle ψ after BDC, which reduces VC. Angle ψ can be calculated from Th, Tc, and either ΔTh or ΔTc.

b) COMPRESSION. Following the end of INTAKE, passages between work space 4 and heat exchangers L and H, via rotary valve 7, are blocked and gas in work space 4 is adiabatically compressed during movement of piston 3 towards TDC. Compression continues until pressure in 4 exceeds pressure in heat exchanger H, whereupon one-way valve 13 opens and gas in 4 is expelled into heat exchanger H until piston 3 reaches TDC.

c) CONSTANT PRESSURE HEAT TRANSFER IN HEAT EXCHANGER H. During transit of working gas through heat exchanger H, gas temperature is reduced from Th+ΔTh to Th by heat transfer to the environment if the invention is used as a refrigerator. If the invention is used as a heat engine, gas temperature during transit of heat exchanger H is increased from Th−ΔTh to Th by heat transfer from a heat source.

d) EXPANSION. During an interval from TDC to [TDC+2θ of crank rotation], where θ is the angle indicated in FIG. 2 and the factor of 2 is a consequence of the 2:1 reduction in rotational speed of rotary valve 7, a passage is created between work space 4 and H(out) via groove 16*a*, hole h16, and groove 16*b*, and gas enters work space 4. Angle θ calculated from specified hot and cold temperatures (Th and Tc respectively) and one of the temperature increments ΔTh or ΔTc.

In an engine embodiment, during the subsequent interval {[TDC+2θ of crank rotation] to BDC}, all passages to work space 4 are blocked and gas in 4 expands. During the further subsequent interval from BDC to TDC, a passage is created between work space 4 and L(in) via groove 17*a*, hole h17, and groove 17*b*, and expanded gas in work space 4 is expelled into heat exchanger L. In order to satisfy inequality 1 in a refrigerator embodiment, all passages to work space 4 are blocked during an interval {[TDC+2θ of crank rotation] to an angle Φ after BDC}, which reduces VE. Angle Φ can be calculated from Th, Tc, and either ΔTh or ΔTc. During this interval, gas in 4 expands. During the further subsequent interval from Φ after BDC to TDC, a passage is created between work space 4 and L(in) via groove 17*a*, hole h17, and groove 17*b*, and expanded gas in work space 4 is expelled into heat exchanger L.

E) CONSTANT PRESSURE HEAT TRANSFER IN HEAT EXCHANGER L.

During transit of heat exchanger L by working gas, gas temperature is increased from (Tc−ΔTc) to Tc by heat transfer from a refrigerated space if the invention is used as a refrigerator. If the invention is used as a heat engine, gas temperature during transit of heat exchanger H is reduced from (Tc+ΔTc) to Tc by heat transfer to the environment. Gas exiting heat exchanger L returns to work space 4 to repeat process a) and the remainder of the cycle.

The second basic embodiment shown in FIG. 2 functions identically to the first basic embodiment, except that; if the invention is used as a refrigerator, the crankshaft is driven by an electric motor inside enclosure 1, and if the invention is used as a heat engine, the crankshaft supplies power to an electric generator inside enclosure 1.

Figure 6:
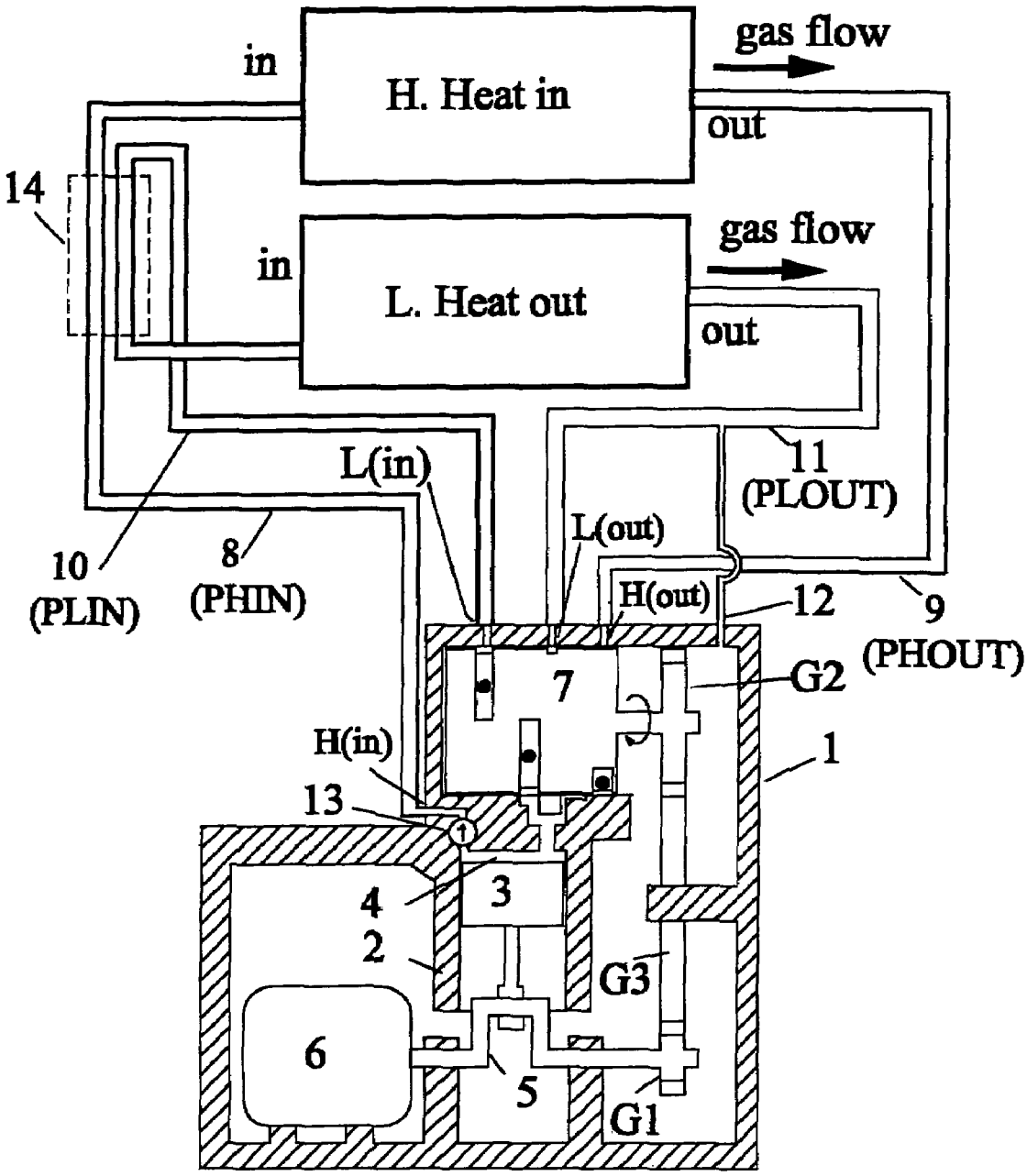
FIG. 6 shows a preferred embodiment of a heat engine according to the invention.
Figure 7:
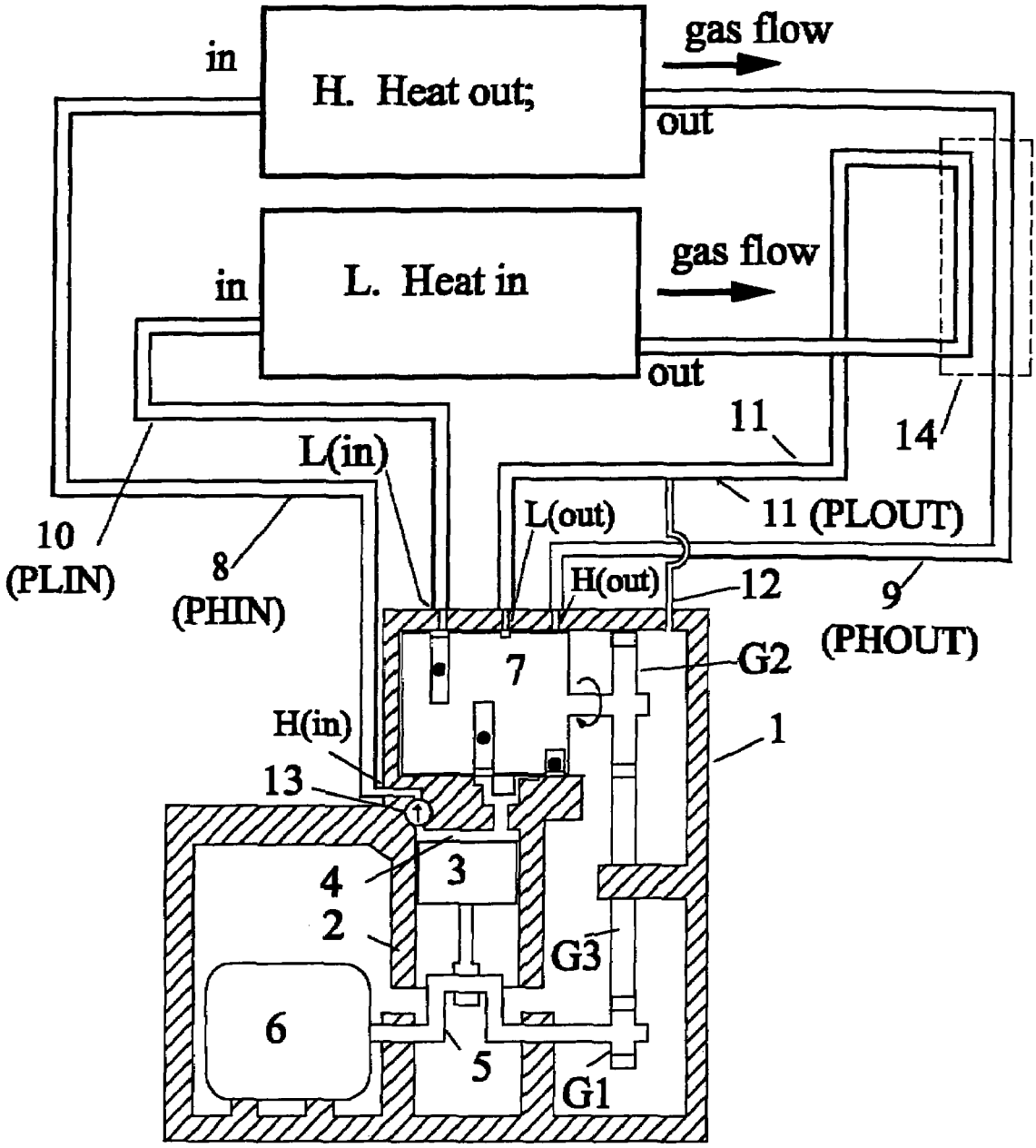
FIG. 7 shows a preferred embodiment of a refrigerator according to the invention.

It will now be shown that either basic embodiment of an engine can be improved by combining it with counterflow heat exchanger 14 as shown in FIG. 5 to form a preferred engine embodiment. Similarly, either basic embodiment of a refrigerator can be improved by combining it with counterflow heat exchanger 15 as shown in FIG. 6 to form a preferred refrigerator embodiment.

Figure 8:
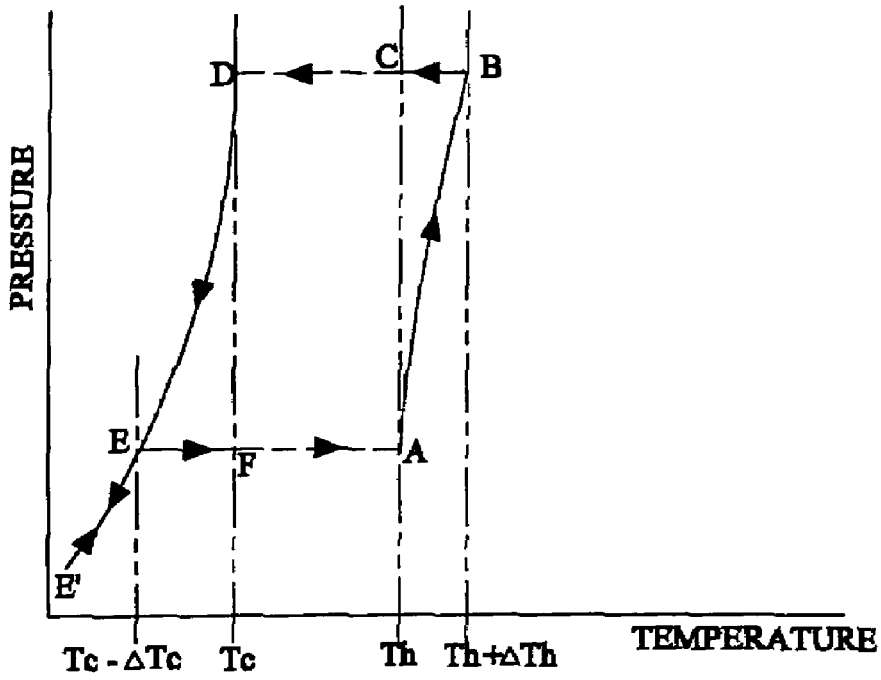
FIG. 8 shows a refrigeration thermodynamic cycle according to the preferred embodiment of the invention.
Figure 9:
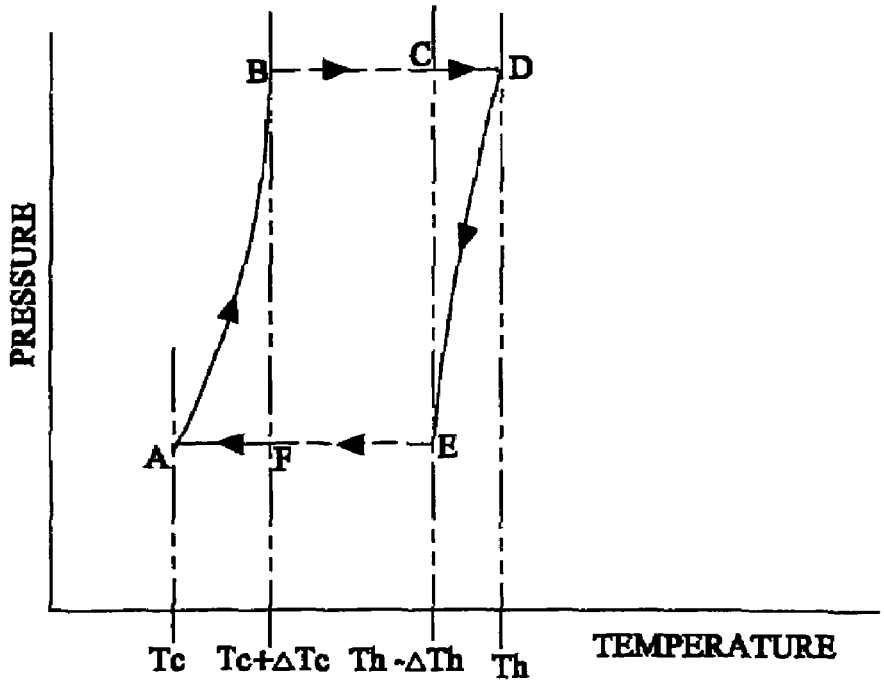
FIG. 9 shows a heat engine thermodynamic cycle according to the preferred embodiment of the invention.

The thermodynamic cycles of the preferred refrigerator and engine embodiments, assuming a perfect counterflow heat exchanger, are shown in FIGS. 8 and 9, respectively. In the preferred refrigerator cycle (FIG. 8), equal and opposite heat transfers C-D and F-A occur in the counterflow heat exchanger, and the process E-E'-E occurs during the expansion interval from BDC−2Φ to BDC+2Φ. In the preferred engine cycle (FIG. 9), equal and opposite heat transfers B-C and E-F occur in the counterflow heat exchanger By comparing FIGS. 8 and 9 to FIGS. 4 and 5, it can be shown from basic thermodynamics that that P(high)/P(low) for the preferred embodiment of a refrigerator is reduced by a factor $$\left(\frac{T_c}{T_h}\right)^{\frac{\gamma-1}{\gamma}}$$

compared to the basic embodiment, and by a similar factor for a heat engine, where γ=specific heat ratio of working gas.

In most applications, reduction of P(high)/P(low) by a factor $$\left(\frac{T_c}{T_h}\right)^{\frac{\gamma-1}{\gamma}}$$

is significant because, if P(high) is limited by structural or safety considerations, then $$P(\text{low})\{\text{preferred embodiment}\}>P(\text{low})\{\text{basic embodiment}\}.$$

Since mass flow through the system is proportional to gas density during intake, which is itself proportional to P(low), it follows that mass flow through a preferred embodiment can be substantially greater than that of the basic embodiment, leading to higher [heat lift/piston displacement] in the refrigerator case and higher [power output/piston displacement] in the heat engine case.

Another important practical advantage of the preferred embodiments over the basic embodiments is a lower value of [P(high)-P(low], which reduces leakage and reduces starting torque.

In application of the invention to refrigeration where Th/Tc does not greatly exceed 1.0, for example, air conditioning and domestic refrigeration, in which Th/Tc≅1.1, the ratio P(high)/P(low) is low enough for the basic embodiments to be practical, thus avoiding the cost of the counterflow heat exchanger required by the preferred embodiment.

Detailed calculations comparing a freezer according to a preferred embodiment of the invention (Tc=−18 C, Th=32 C, P(low)=34 bar, crankshaft speed=1800 RPM, helium refrigerant) with a vapor compression freezer using R134a refrigerant show cycle coefficients of performance (defined as heat lift/power input) of 3.40 and 1.77 respectively, and a refrigeration capacity for the invention of 1000 Watts for 124 cc of piston displacement Detailed calculations comparing a refrigerator according to a preferred embodiment of the invention (Tc=4C, Th=32C P(low)=34 bar, crankshaft speed=1800 RPM, helium refrigerant) with a vapor compression refrigerator using R134a refrigerant show cycle coefficients of performance of 5.77 and 3.88 respectively, and a refrigeration capacity for the invention of 1000 Watts for 140 cc of piston displacement.

Detailed design of an air conditioner according to a basic embodiment of the invention (Tc=16C, Th=32C, crankshaft speed=1800 RPM, nitrogen refrigerant, P(low)=23 bar) gives cycle C.O.P.=8.03 and cooling capacity of 1000 Watts for 76 cc of piston displacement. In automotive application the air conditioner could be engine driven by using a shaft seal that would contain pressurized nitrogen.

Detailed design of a heat engine according to a preferred embodiment of the invention (Th=525C, Tc=35C, P(low) =23 bar, 1800 RPM, and nitrogen as the working gas) gives cycle efficiency=0.54 and power output of 1000 Watts for 76 cc of piston displacement. Shaft power could be obtained by using a shaft seal that would contain pressurized nitrogen.

A variation that would be obvious to one skilled in the art is multiple cylinders in the same sealed enclosure, driving or being driven by the same crankshaft. Another obvious variation is addition of a fourth section of rotary valve 7 to replace one-way valve 13, which replacement has the disadvantage of increasing starting torque.

While certain preferred embodiments of the present invention have been disclosed in detail, it is to be understood that various modifications may be adopted without departing from the spirit of the invention or scope of the following claims.

The invention claimed is:

1. A refrigerator comprising, a sealed enclosure containing a cylinder and a piston, the piston driven in reciprocation within the cylinder by a crankshaft, one end of the crankshaft passing from the interior to the exterior of the sealed enclosure through a shaft seal, a work space bounded by the piston and cylinder, a high pressure heat exchanger designated herein by H, H having an inlet and an outlet, the inlet to H connected to the sealed enclosure by a sealed passage designated herein as PHIN, PHIN entering the sealed enclosure at a port designated herein as Hin, the outlet from H connected to the sealed enclosure by a sealed passage designated herein as PHOUT, PHOUT entering the sealed enclosure at a port designated herein as Hout, a low pressure heat exchanger designated herein by L, L having an inlet and an outlet, the inlet to L connected to the sealed enclosure by a sealed passage designated herein as PLIN, PLIN entering the sealed enclosure at a port designated herein as Lin, the outlet from L connected to the sealed enclosure by a sealed passage designated herein as PLOUT, PLOUT entering the sealed enclosure at a port designated herein as Lout, a one-way valve in a sealed passage between the work space and port Hin, a working gas filling the entire apparatus, a rotary valve rotating at one-half crankshaft speed, the rotary valve creating passages in the following sequence, a) in the interval between piston top dead center (TDC) and piston bottom dead center (BDC), the rotary valve creates a passage between the work space and L(out), b) in the subsequent interval BDC to TDC, no passage is created by the rotary valve, c) in the subsequent interval TDC to an angle of crankshaft rotation 2θ after TDC, where θ is an angle less than 90 degrees, the rotary valve creates a passage between the work space and H(out), d) in the subsequent interval from an angle of crankshaft rotation of 2θ after TDC to 2Φ after BDC, where Φ is an angle less than 90 degrees, no passage is created by the rotary valve, e) in the subsequent interval from an angle of crankshaft rotation of 2Φ after BDC to TDC, the rotary valve creates a passage between the work space and L(in).

2. The combination of a refrigerator according to claim 1 and a counterflow heat exchanger, the counterflow heat exchanger transferring heat between passages PHOUT and PLOUT.

3. A refrigerator comprising, a sealed enclosure containing a cylinder and a piston, the piston driven in reciprocation within the cylinder by a crankshaft, the crankshaft rotated by an electric motor, the electric motor within the sealed enclosure, a work space bounded by the piston and cylinder, a high pressure heat exchanger designated herein by H, H having an inlet and an outlet, the inlet to H connected to the sealed enclosure by a sealed passage designated herein as PHIN, PHIN entering the sealed enclosure at a port designated herein as Hin, the outlet from H connected to the sealed enclosure by a sealed passage designated herein as PHOUT, PHOUT entering the sealed enclosure at a port designated herein as Hout, a low pressure heat exchanger designated herein by L, L having an inlet and an outlet, the inlet to L connected to the sealed enclosure by a sealed passage designated herein as PLIN, PLIN entering the sealed enclosure at a port designated herein as Lin, the outlet from L connected to the sealed enclosure by a sealed passage designated herein as PLOUT, PLOUT entering the sealed enclosure at a port designated herein as Lout, a one-way valve in a sealed passage between the work space and port Hin, a working gas filling the entire apparatus, a rotary valve rotating at one-half crankshaft speed, the rotary valve creating passages in the following sequence, a) in the interval between piston top dead center (TDC) and piston bottom dead center (BDC), the rotary valve creates a passage between the work space and L(out), b) in the subsequent interval BDC to TDC, no passage is created by the rotary valve, c) in the subsequent interval TDC to an angle of crankshaft rotation 2θ after TDC, where θ is an angle less than 90 degrees, the rotary valve creates a passage between the work space and H(out), d) in the subsequent interval from an angle of crankshaft rotation of 2θ after TDC to 2Φ after BDC, where Φ is an angle less than 90 degrees, no passage is created by the rotary valve, e) in the subsequent interval from an angle of crankshaft rotation of 2Φ after BDC to TDC, the rotary valve creates a passage between the work space and L(in).

4. The combination of a refrigerator according to claim 3 and a counterflow heat exchanger, the counterflow heat exchanger transferring heat between passages PHOUT and PLOUT.

5. A heat engine comprising, a sealed enclosure containing a cylinder and a piston, gas forces on the piston driving the piston in reciprocation within the cylinder, reciprocation of the piston causing a crankshaft to rotate, one end of the rotating crankshaft passing from the interior to the exterior of the sealed enclosure through a shaft seal, a work space bounded by the piston and cylinder, a high pressure heat exchanger designated herein by H, H having an inlet and an outlet, the inlet to H connected to the sealed enclosure by a sealed passage designated herein as PHIN, PHIN entering the sealed enclosure at a port designated herein as Hin, the outlet from H connected to the sealed enclosure by a sealed passage designated herein as PHOUT, PHOUT entering the sealed enclosure at a port designated herein as Hout, a low pressure heat exchanger designated herein by L, L having an inlet and an outlet, the inlet to L connected to the sealed enclosure by a sealed passage designated herein as PLIN, PLIN entering the sealed enclosure at a port designated herein as Lin, the outlet from L connected to the sealed enclosure by a sealed passage designated herein as PLOUT, PLOUT entering the sealed enclosure at a port designated herein as Lout, a one-way valve in a sealed passage between the work space and port Hin, a heat source, the heat source transferring heat to H, a working gas filling the entire apparatus, a rotary valve rotating at one-half crankshaft speed, the rotary valve creating passages in the following sequence, a) in the interval between piston top dead center (TDC) and an angle 2ψ of crankshaft rotation after piston bottom dead center (BDC), where ψ is an angle less than 90 degrees, the rotary valve creates a passage between the work space and L(out), b) in the subsequent interval between 2ψ of crankshaft rotation after BDC to TDC, no passage to the work space is created by the rotary valve, c) in the subsequent interval TDC to an angle of crankshaft rotation 2θ after TDC, where θ is an angle less than 90 degrees, the rotary valve creates a passage between the work space and H(out), d) in the subsequent interval from an angle of crankshaft rotation of 2θ after TDC to BDC, no passage to the work space is created by the rotary valve, e) in the subsequent interval from BDC to TDC, a passage between the work space and L(in) is created by the rotary valve.

6. The combination of a heat engine according to claim 5 and a counterflow heat exchanger, the counterflow heat exchanger transferring heat between passages PHIN and PLIN.

7. A heat engine comprising, a sealed enclosure containing a cylinder and a piston, gas forces on the piston driving the piston in reciprocation within the cylinder, reciprocation of the piston causing a crankshaft to rotate, the rotating crankshaft turning an electric generator, the electric generator within the sealed enclosure, a work space bounded by the piston and cylinder, a high pressure heat exchanger designated herein by H, H having an inlet and an outlet, the inlet to H connected to the sealed enclosure by a sealed passage designated herein as PHIN, PHIN entering the sealed enclosure at a port designated herein as Hin, the outlet from H connected to the sealed enclosure by a sealed passage designated herein as PHOUT, PHOUT entering the sealed enclosure at a port designated herein as Hout, a low pressure heat exchanger designated herein by L, L having an inlet and an outlet, the inlet to L connected to the sealed enclosure by a sealed passage designated herein as PLIN, PLIN entering the sealed enclosure at a port designated herein as Lin, the outlet from L connected to the sealed enclosure by a sealed passage designated herein as PLOUT, PLOUT entering the sealed enclosure at a port designated herein as Lout, a one-way valve in a sealed passage between the work space and port Hin, a heat source, the heat source transferring heat to H, a working gas filling the entire apparatus, a rotary valve rotating at one-half crankshaft speed, the rotary valve creating passages in the following sequence, a) in the interval between piston top dead center (TDC) and an angle 2ψ of crankshaft rotation after piston bottom dead center (BDC), where ψ is an angle less than 90 degrees, the rotary valve creates a passage between the work space and L(out), b) in the subsequent interval between 2ψ of crankshaft rotation after BDC to TDC, no passage to the work space is created by the rotary valve, c) in the subsequent interval TDC to an angle of crankshaft rotation 2θ after TDC, where θ is an angle less than 90 degrees, the rotary valve creates a passage between the work space and H(out), d) in the subsequent interval from an angle of crankshaft rotation of 2θ after TDC to BDC, no passage to the work space is created by the rotary valve, e) in the subsequent interval from BDC to TDC, a passage between the work space and L(in) is created by the rotary valve.

8. The combination of a heat engine according to claim 7 and a counterflow heat exchanger, the counterflow heat exchanger transferring heat between passages PHIN and PLIN.

* * * * *